US006975826B2

(12) United States Patent
Selinger et al.

(10) Patent No.: US 6,975,826 B2
(45) Date of Patent: Dec. 13, 2005

(54) DEVICE AND METHOD TO LIFT MAGNETIZABLE CARRIER PARTICLES FROM A MIXTURE OF TONER PARTICLES AND MAGNETIZABLE CARRIER PARTICLES

(75) Inventors: Ralf Selinger, Munich (DE); Uwe Huellig, Munich (DE); Stefan Niederhofer, Zorneding (DE)

(73) Assignee: Océ Printing Systems GmbH, Poing (DE)

( * ) Notice: Subject to any disclaimer, the term of this patent is extended or adjusted under 35 U.S.C. 154(b) by 108 days.

(21) Appl. No.: 10/672,194

(22) Filed: Sep. 26, 2003

(65) Prior Publication Data

US 2004/0105706 A1 Jun. 3, 2004

(30) Foreign Application Priority Data

Oct. 2, 2002 (DE) ..... 102 46 022

(51) Int. Cl.[7] ..... G03G 15/09
(52) U.S. Cl. ..... 399/273
(58) Field of Search ..... 399/264, 271, 399/273, 276, 277, 280, 281, 283, 356, 279

(56) References Cited

U.S. PATENT DOCUMENTS

| | | | | |
|---|---|---|---|---|
| 3,939,098 | A | 2/1976 | Larrabee | |
| 4,530,597 | A * | 7/1985 | Itaya et al. | 399/356 |
| 5,404,215 | A * | 4/1995 | Bares | 399/264 |
| 5,851,719 | A | 12/1998 | Takei et al. | |
| 5,854,961 | A | 12/1998 | Wibbels et al. | |
| 6,196,958 | B1 * | 3/2001 | Shiraki et al. | 399/281 |
| 2001/0024579 | A1 | 9/2001 | Onuki et al. | |

FOREIGN PATENT DOCUMENTS

| | | |
|---|---|---|
| DE | 101 52 892 | 5/2003 |
| JP | 06011970 | 1/1994 |
| JP | 11311903 | 11/1999 |
| JP | 2000035717 | 2/2000 |

* cited by examiner

*Primary Examiner*—Arthur T. Grimley
*Assistant Examiner*—Ryan Gleitz
(74) *Attorney, Agent, or Firm*—Schiff Hardin LLP

(57) ABSTRACT

In a device and method for lifting magnetizable carrier particles from a mixture of toner particles, a cover of a collecting element interface device is arranged such that it can be rotated around a stator with a magnet. The cover comprises a spiral that, given rotation of the cover, conveys the carrier particles in an axial direction.

10 Claims, 6 Drawing Sheets

DEVICE AND METHOD TO LIFT MAGNETIZABLE CARRIER PARTICLES FROM A MIXTURE OF TONER PARTICLES AND MAGNETIZABLE CARRIER PARTICLES

BACKGROUND OF THE INVENTION

The invention concerns a device to lift magnetizable carrier particles. Furthermore, the invention concerns a method to lift carrier particles.

In electrographic printers or copiers, two-component toner systems are frequently used that comprise a mixture of ferromagnetic carrier particles and toner particles. A magnetic roller arrangement transports the two-component mixture in a region with little separation between the magnetic roller arrangement and the surface of an applicator element to be inked with toner particles, for example a roller or a ribbon. The toner particles are transferred to the surface of the applicator element, whereby magnetic forces hold back the ferromagnetic carrier particles. However, in practice it can occur that ferromagnetic carrier particles that adhere to the toner particles are transferred with them or are mechanically flung onto the surface of the applicator element. These very hard magnetizable carrier particles are then active outside of the development process and can damage the print system or copier system or, due to the contamination, can cause print image interference.

A method and a device to clean carrier elements in printers or copiers using magnetic fields is specified from DE 101 52 892, incorporated herein by reference. In this patent application, the development process is specified in detail with the aid of two-component systems and the application of magnetic fields to ferromagnetic carrier particles. The content of this patent application is hereby incorporated in the disclosure contents of the present patent application.

It is known from operational practice to use an angle stripper that exhibits a magnetic field to lift magnetizable carrier particles. The angle stripper faces at the distance of an air gap a carrier surface that carries the mixture of toner particles and carrier particles. With the aid of the magnetic forces, magnetizable carrier particles are captured. The problem hereby exists that toner taken along by the carrier particles or freely straying (vagrant) toner dust deposits on the surface of the angle stripper via adhesion or triboelectric or electrostatic charging. Viewed over a longer operation time, toner layers can assemble increasingly stronger, such that it can lead to function disruption. Furthermore, the lifted carrier particles must again be removed from the surface of the angle stripper and, if possible, are again supplied to the two-component mixture in the developer station so that the ratio of carrier particles and toner particles remains constant in the two-component mixture in the developer station. In the developer station, frequently a very limited space is present, such that the return of the carrier particles and also the lifted toner particles causes problems.

SUMMARY OF THE INVENTION

It is an object of the invention to specify a device and a method that enables a safe lifting of magnetizable carrier particles and ensures a safe delivery of the carrier particles.

In a device and method for lifting magnetizable carrier particles, a cover of a collecting element is rotated around a stationary stator and wherein the stator comprises at least one magnet having a pole arranged approximately radial to the cover and a magnetic field which attracts ferro-magnetic carrier particles located on a carrier at a distance of an air gap. A surface of the cover comprises at least one screw-thread type spiral so that, given rotation of the cover, the carrier particles move in an axial direction relative to the cover.

DESCRIPTION OF THE PREFERRED EMBODIMENTS

Figure 1A:
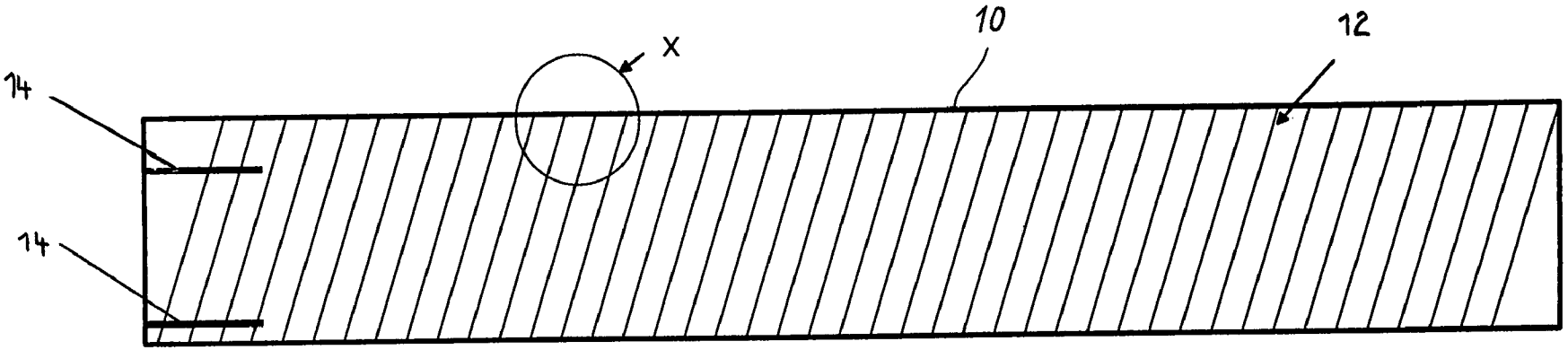
FIGS. 1A and 1B are a depiction of a collecting roller with spiral-shaped channels.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A cover of a collecting element, preferably a non-magnetic hollow cylinder, can be rotated around a stationary stator. This stator comprises at least one magnet whose one pole is arranged approximately radial to the cover and whose magnetic field attracts the ferromagnetic carrier particles. An air gap is provided between the carrier particles and the surface of the cover. At least one spiral according to a type of threading is present on the surface of the cover, preferably as a spiral elevation or depression which, upon rotating the cover, moves the carrier particles in the direction axial to the cover. The ferromagnetic carrier particles are thereby adhered via the magnetic field, such that between the carrier particles and the surface of the cover a relative motion occurs in the circumferential direction and in the axial direction dependent on the lead of the spiral. Due to the axial motion of the carrier particles on the surface of the cover, the carrier particles are systematically conveyed to a desired location and can there be discarded. At the same time, due to the relative motions the surface of the cover is cleaned of deposited toner particles, whereby a safe operating mode occurs.

According to a further aspect, a method is specified to lift magnetizable carrier particles. The technical effects that can be achieved with this method coincide with those according to the specified device.

It should be noted that the cited device and the method can be used anywhere ferromagnetic carrier particles that are arranged on a flat or curved carrier surface should be selected.

Figure 1B:
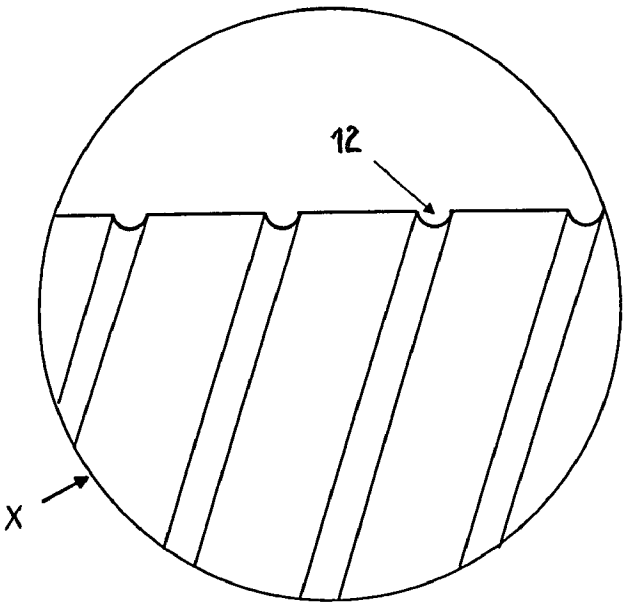

FIGS. 1A and 1B show an exemplary embodiment of a collecting roller 10 designed as a collecting element. In FIG. 1B, a section X of FIG. 1A is shown enlarged. The collecting roller 10 comprises as a spiral a spiral-shaped channel 12 according to a type of threading. As is to be recognized in the detail cut-out X, the channel 12 has a specific width and depth that can be adapted to the size of the ferromagnetic carrier particles. On the left edge of the collecting roller 10, two grooves 14 are sunk into the surface of the collecting roller 10. These grooves 14 serve as a discarding device. When the carrier particles conveyed in the direction axial to the collecting roller 10 reach these grooves 14, they are taken away by the grooves 14 and discarded from the collecting roller 10. In place of the grooves 14, elevations or carrier ridges or fins can also be arranged as discarding devices. A further variant exists to bring the magnetic field to a value near zero in a region of the discarding location such that the ferromagnetic carrier particles are no longer held to the surface of the collecting roller 10, and thus also clean the cover surface via the relative motion.

Figure 2:
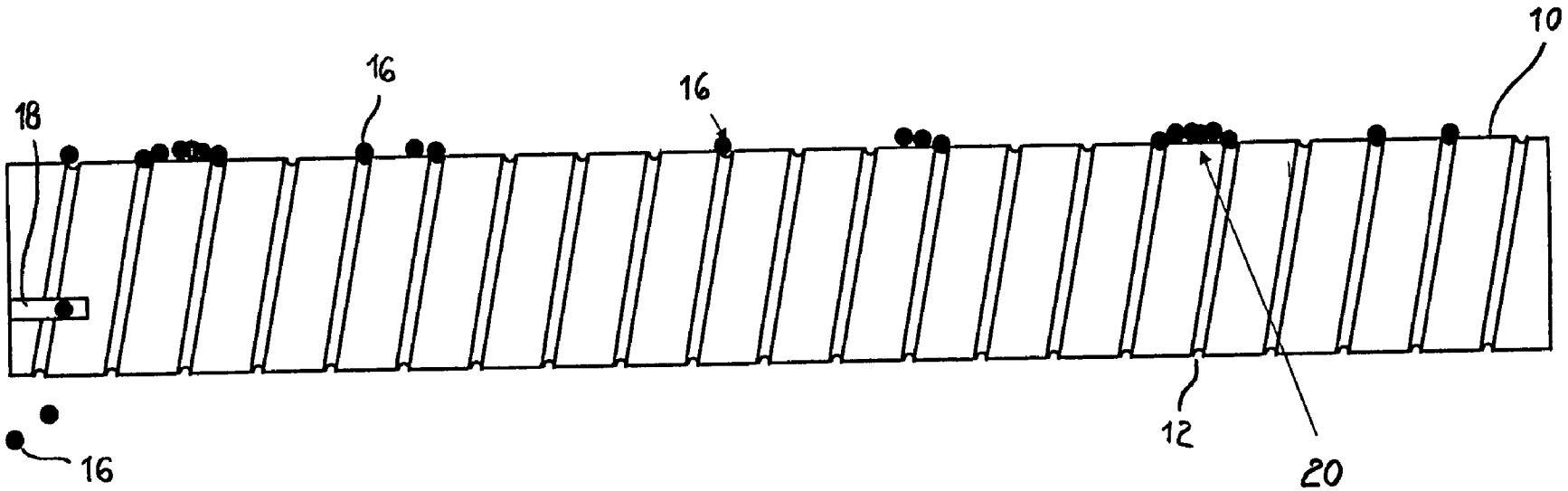
FIG. 2 shows an example with carrier particles adhering to the surface of the cover.

FIG. 2 shows the exemplary embodiment according to FIGS. 1A, 1B with carrier particles 16 that are transported via rotation of the collecting roller 10 counterclockwise towards the left to a carrier fin 18, and are there discarded. In the area 20, an accumulation of carrier particles is visible that are moved axially to the left in the channel 12 via carrier particles.

Figure 3:
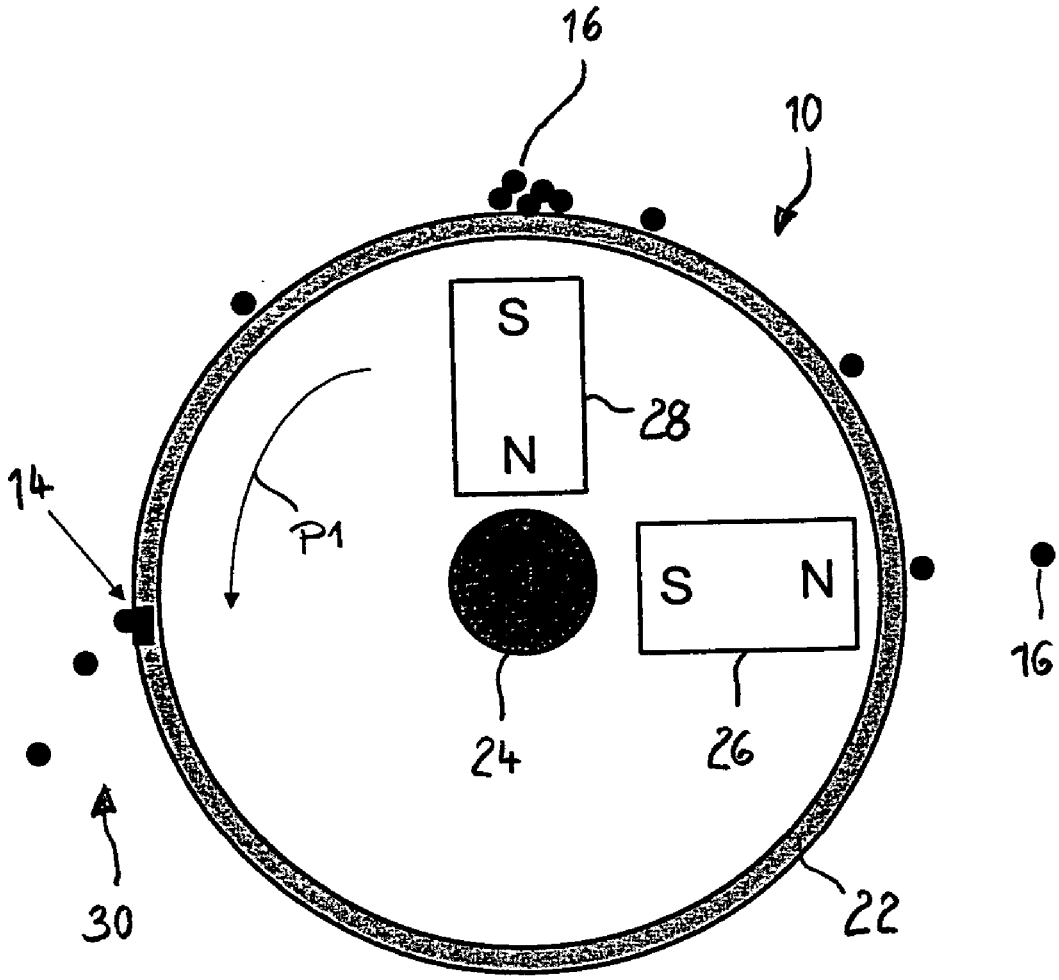
FIG. 3 shows an arrangement of the cover with internal stationary stator and two magnets.

FIG. 3 shows schematically a side view of the collecting roller 10. It comprises a cover 22 that is designed as a hollow cylinder. Inside the cover 22, a stator 24 is arranged with two magnets 26, 28. The stator 24 with the magnets 26, 28 is stationary, while the cover 22 is rotated in the direction of the rotation arrow P1. The magnet 26 serves as an attracting magnet, i.e. it attracts carrier particles 16. The long axis of the magnet 26 is aligned approximately radial. The magnet 28 serves as a transporting magnet; its lengthwise axis is aligned radially and has an angular separation of approximately 90° to the pole axis of the magnet 26. The poles of the magnets 26, 28 facing outwards have different polarity, i.e. a concentrated magnetic flux occurs from the north pole of the magnet 26 to the south pole of the magnet 28.

Using the FIG. 3, the functional principle is explained. The magnet 26 attracts ferroelectric carrier particles 16 with its magnetic field active outwards, such that these adhere to the surface of the cover 22. Given rotation of the cover 22 counterclockwise in the direction P1, the carrier particles 16 are conveyed to the area of the south pole of the magnet 28 and are held there by the magnetic force of the magnet 28. A relative motion thus occurs between the surface of the cover 22 and the accumulation of the carrier particles 16 in the area of the south pole of the magnet 28. Due to the screw-shaped channel 12 (not visible in FIG. 3), the accumulation of carrier particles 16 is conveyed in the direction perpendicular to the paper plane, whereby a further relative motion occurs. When the conveyed carrier particles 16 reach the region of the grooves 14, they are taken away by the grooves and are discarded in the region of the discarding location 30.

Figure 4:
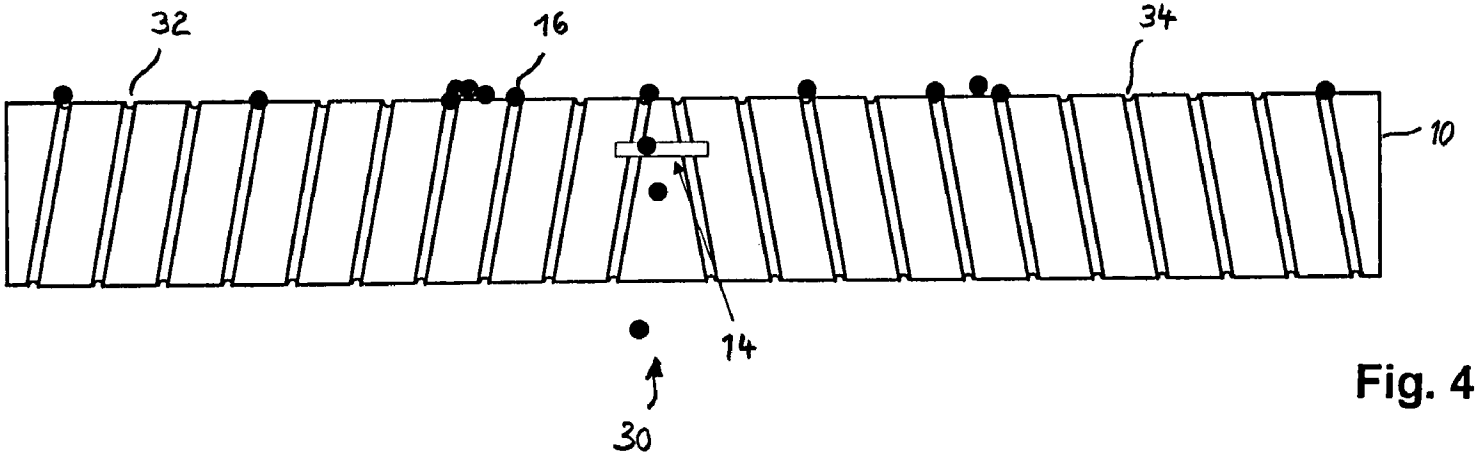
FIG. 4 illustrates a collecting roller with a central discarding location for the carrier particles.

FIG. 4 shows an example in which a channel 32 is designed coil-shaped on the surface of the collecting roller 10 according to a type of right-handed thread, and the channel 34 is designed according to a type of left-handed thread. The discarding device, for example grooves 14 or fins, is arranged where both channels 32, 34 meet, here in this example approximately in the middle. In this type of design of the collecting roller 10, the discarding location 30 lies in the middle of the collecting roller 10.

Figure 5:
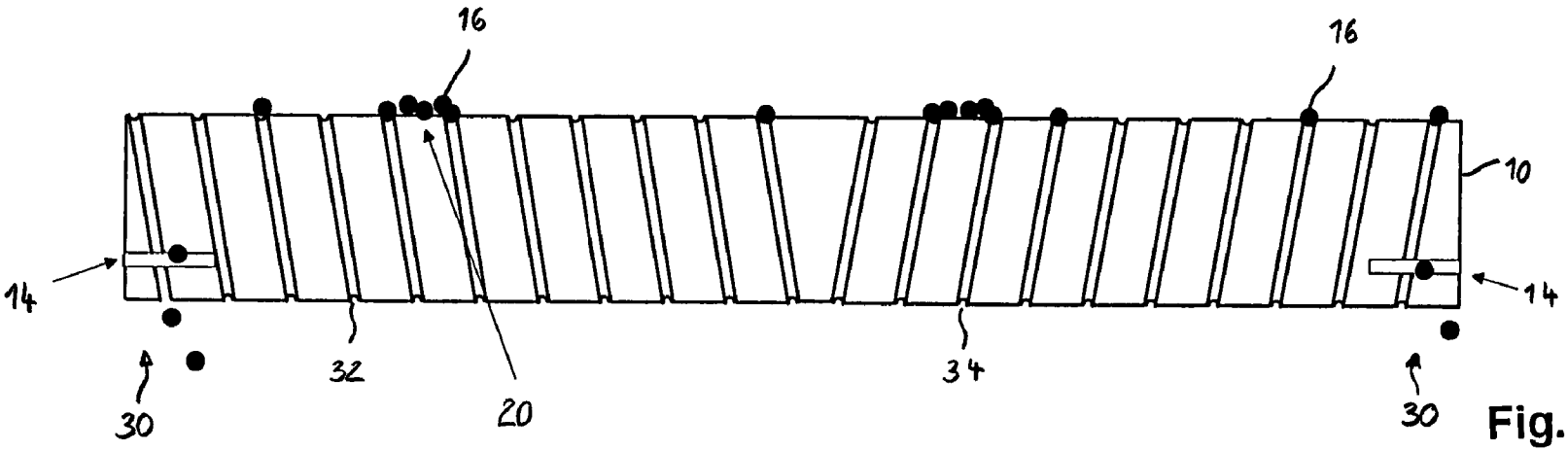
FIG. 5 shows a collecting roller with two discarding locations in the end regions.

FIG. 5 shows another example. The channels 32, 34 are likewise designed in the opposite direction and convey the carrier particles 16 outwards to the edge regions of the collecting roller 10 where they are discarded by the grooves 14. Two discarding locations thus occur here at the edge. Given the axial motion of the carrier particles 16, these rub against the surface of the cover 22 and clean it of deposited toner particles, as this ensues, for example, at the location 20. The toner particles adhere due to the triboelectric charge and adhesion to the surface of the cover 22 to the surface of the carrier particles 16. The number of discarding locations 30, as well as the lead for a plurality of spiral-shaped channels and the direction of the thread, can only be designed such that the discarding locations 30 are set where corresponding catch locations or catch devices are present. In this manner, an improvement of the design possibilities occurs, for example, inside of a developer station. Via the selection of a plurality of discarding locations 30, the accumulating quantity of carrier particles 16 and for the most part scarce space within a housing can be accommodated.

Figure 6:
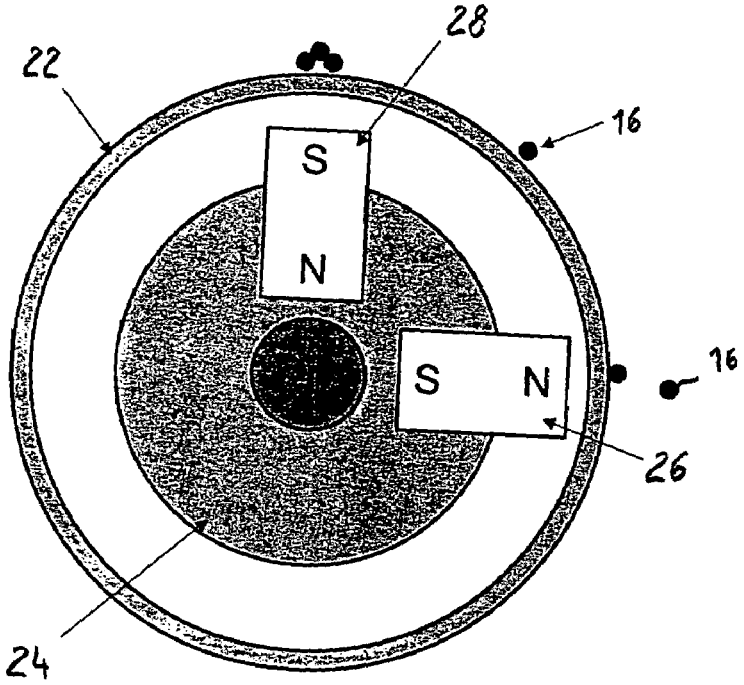
FIG. 6 illustrates a collecting roller with an attracting magnet and a transporting magnet.

FIG. 6 shows the example according to FIG. 3 with further details. The magnets 26, 28 are designed such that on the one hand the magnet 26 transports the carrier particles 16 to the surface of the cover 22, and on the other hand the magnet 28, given rotation of the cover 22, conveys the acquired carrier particles 16 optimally in the axial direction of the cover 22.

Figure 7:
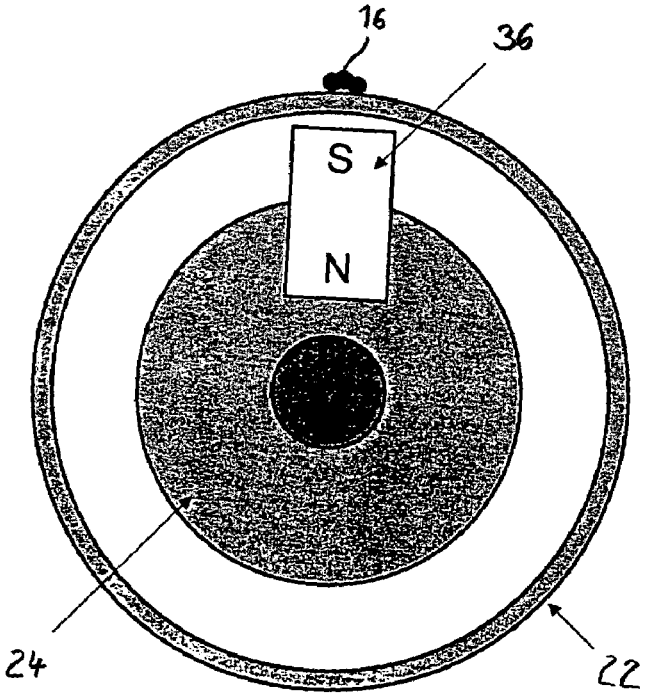
FIG. 7 shows a stator with a single magnet.

FIG. 7 shows an example in which a single magnet 36 undertakes the function of catching the carrier particles 16 and axially transporting the carrier particles 16. A simple and cost-effective assembly thus occurs. This variation is offered when the quantity of carrier particles 16 to be lifted is relatively small and an accumulation of carrier particles 16 at this location leads to no problem in the overall system. In the variation according to claim 6, the carrier particles 16 that are attracted by the magnet 26 are transferred (preferably via the magnetic field lines between the north pole of the magnet 26 and the south pole of the magnet 28) to the transporting magnet 28 and held there. Such an arrangement is advantageous when the lifted carrier particles can not dwell at the pole location of the magnet 26, for example due to the narrow air gap, since the quantity to be lifted is too large. On the other hand, the division of the functions of attracting carrier particles and holding them and axially conveying the carrier particles is advantageous for reasons of design.

Figure 8:
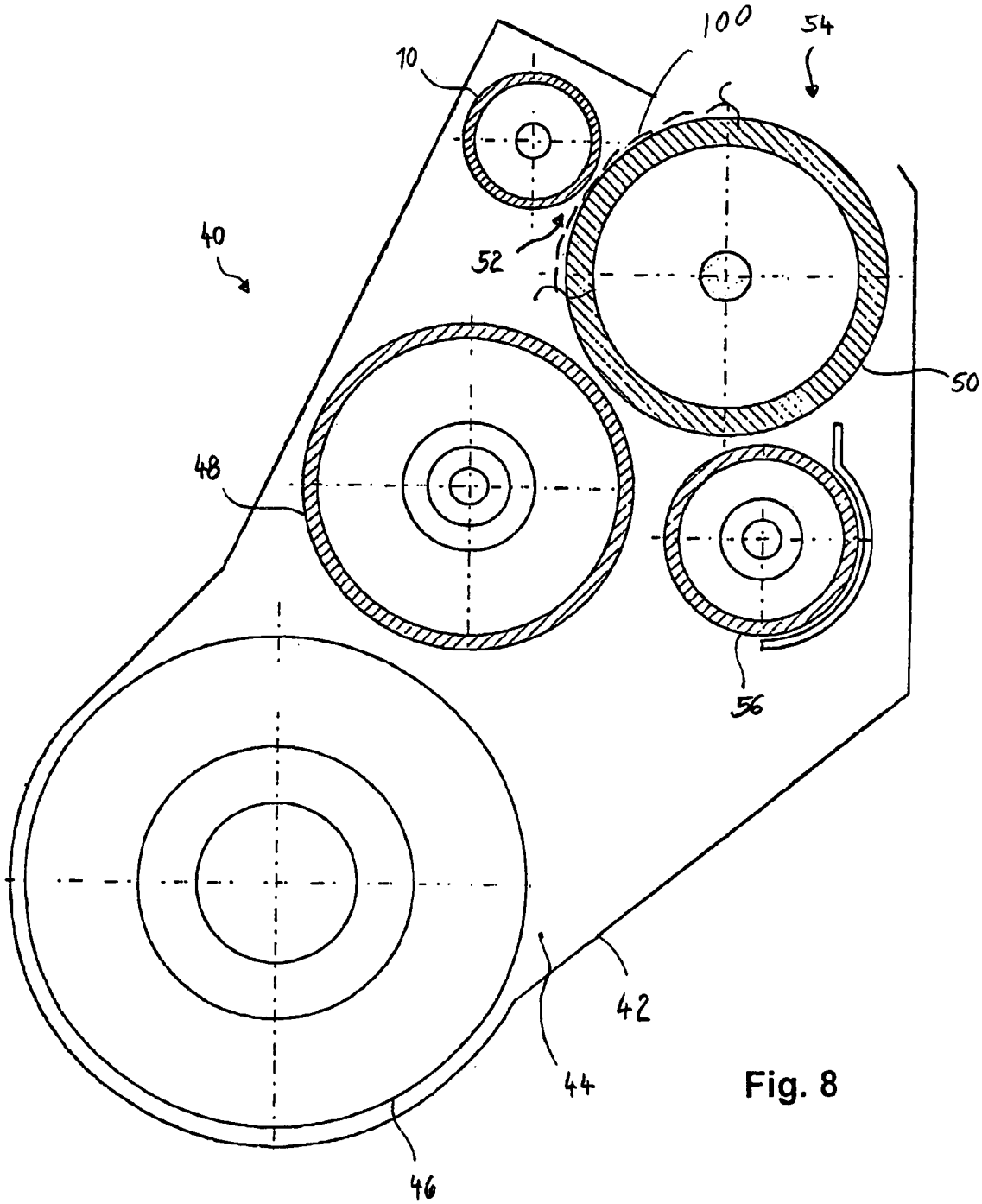
FIG. 8 is a schematic depiction of a developer station with the collecting roller to lift carrier particles from the surface of an applicator roller.

FIG. 8 shows as an exemplary embodiment of a developer station 40 with an indicated housing 42. The two-component mixture comprising toner and ferromagnetic carrier particles is located in the floor region. This mixture is circulated by a paddle wheel 46. A magnetic roller 48 conveys the mixture made of carrier particles and toner particles to an applicator roller, whereby if at all possible only toner particles should be transferred to the surface of the applicator roller 50. The magnetic roller 48 holds the carrier particles back due to its magnetic field. However, this process is imperfect, such that carrier particles to some degree can also arrive together with toner particles on the surface of the applicator (carrier) roller 50. The previously specified collecting roller 10 is arranged at a distance of an air gap 52 from the surface of the applicator roller 50 and catches the carrier particles from the carpet made of toner particles. The caught carrier particles are then again supplied to the two-component mixture. The applicator roller 50 transfers the toner particles to the location 54 on the surface of a photoconductor drum provided with latent images. A cleaning roller 56 removes the untransferred toner particles from the surface of the applicator roller 50. It is to be noted that an applicator ribbon 100 (shown in dashed lines in FIG. 8) can also be used as an applicator carrier element that is arranged opposite the collecting roller 10 that removes ferromagnetic carrier particles from the carpet of toner particles.

Numerous variations of the specified exemplary embodiments are possible. For example, the coil to transport the carrier particles in the axial direction can also comprise elevations in the form of fins. The fins or channels do not have to be designed connected, but rather can also only be present along the extent of the cover in sections. Additionally, a direct voltage field can also act along the axis of the collecting roller 10, for example via application of a high direct voltage. The electrical field is to be selected such that it repels toner particles. In this manner, fewer toner particles are dragged along via the attraction of carrier particles, and free vagrant toner is repelled. An alternating voltage can be overlaid on the direct voltage in order to amplify the effect. The cover 22 can be coated with an anti-adhesive material in order to ease a removal of deposited toner layers via mechanical friction. Many other variations are also possible.

Although preferred exemplary embodiments are shown and specified in detail in the drawings and in the preceding specification, the invention should not be limited to this. It is to be noted that preferred exemplary embodiments are shown and specified, and all variations and modifications that lie within the scope of protection of the invention now and in the future should be protected.

We claim as our invention:

1. A device for lifting magnetizable carrier particles, comprising:

a collecting element having a cover which is rotatable around a stationary stator;

the stator comprises at least one magnet having a pole arranged relative to the cover such that the magnet's magnetic field attracts ferromagnetic carrier particles that are located on a carrier at a distance of an air gap;

a discarding device arranged on a circumferential surface of the cover, the cover being designed as a non-magnetic hollow cylinder that conveys the incoming carrier particles in an axial direction relative to the cover; and a groove on the cover running in an axial direction provided as said discarding device.

2. A device for lifting magnetizable carrier particles, comprising:

a collecting element having a cover which is rotatable around a stationary stator;

the stator comprises at least one magnet having a pole arranged relative to the cover such that the magnet's magnetic field attracts ferromagnetic carrier particles that are located on a carrier at a distance of an air gap;

a surface of the cover comprises at least one screw-thread-like spiral which, given rotation of the cover, moves the carrier particles in an axial direction relative to the cover;

a discarding device arranged on a circumferential surface of the cover, the cover being designed as a non-magnetic hollow cylinder that conveys the incoming carrier particles in an axial direction relative to the cover; and an elevation on the cover running in an axial direction of the cover provided as said discarding device.

3. A device for lifting magnetizable carrier particles, comprising:

a collecting element having a cover which is rotatable around a stationary statir;

the stator comprises at least one magnet having a pole arranged relative to the cover such that the magnet's magnetic field attracts ferromagnetic carrier particles that are located on a carrier at a distance of an air gap;

a surface of the cover comprises at least one screw-thread-like spiral which, given rotation of the cover, moves the carrier particles in an axial direction relative to the cover; and a first spiral according to a type of right-handed thread arranged on the cover, and a second spiral according to a type of left-handed thread arranged on the cover, a discarding device being arranged in an area in which the first spiral and the second spiral meet.

4. A device for lifting magnetizable carrier particles, comprising:

a collecting element having a cover which is rotatable around a stationary stator;

the stator comprises at least one magnet having a pole arranged relative to the cover such that the magnet's magnetic field attracts ferromagnetic carrier particles that are located on a carrier at a distance of an air gap;

a surface of the cover comprises at least one screw-thread-like spiral which, given rotation of the cover, moves the carrier particles in an axial direction relative to the cover; and at least one of a direct voltage and an alternating voltage acting along the cover whose electrical field effects the toner particles.

5. The device according to claim 4 wherein the direct voltage is overlaid by the alternating voltage.

6. A device for lifting magnetizable carrier particles, comprising:

a collecting element having a cover which is rotatable around a stationary stator;

the stator comprises at least one magnet having a pole arranged relative to the cover such that the magnet's magnetic field attracts ferromagnetic carrier particles that are located on a carrier a distance of an air gap;

a surface of the cover comprises at least one screw-thread-like spiral which, given rotation of the cover, moves the carrier particles in an axial direction relative to the cover; and the cover being coated with anti-adhesive material in order to ease removal of deposited toner particles.

7. A device for lifting magnetizable carrier particles, comprising:

a collecting element having a cover which is rotatable around a stationary stator;

the stator comprises at least one magnet having a pole arranged relative to the cover such that the magnet's magnetic field attracts ferromagnetic carrier particles that are located on a carrier at a distance of an air gap;

a surface of the cover comprises at least one screw-thread-like spiral which, given rotation of the cover, moves the carrier particles in an axial direction relative to the cover;

the device being a developer station in a printer or copier; and the cover being arranged at a distance of an air gap near a surface of an applicator roller coated with a mixture made of toner particles and magnetizable carrier particles.

8. A device for lifting magnetizable carrier particles, comprising:

a collecting element having a cover which is rotatable around a stationary stator;

the stator comprises at least one magnet having a pole arranged relative to the cover such that the magnet's magnetic field attracts ferromagnetic carrier particles that are located on a carrier at a distance of an air gap;

a surface of the cover comprises at least one screw-thread-like spiral which, given rotation of the cover, moves the carrier particles in an axial direction relative to the cover; and the cover being arranged opposite an intermediate carrier ribbon as said carrier which carries a mixture made of toner particles and magnetizable carrier particles, and where said air gap exists between the cover and the mixture.

9. A method for lifting magnetizable carrier particles, comprising the steps of:

rotating a cover of a collecting element around a stationary stator, and wherein the stator comprises at least one magnet having a pole arranged approximately radial to the cover and a magnetic field which attracts ferromagnetic carrier particles located on a carrier at a distance of an air gap;

providing a surface of the cover with at least one screw-thread like spiral so that, given rotation of the cover, the carrier particles move in an axial direction relative to the cover;

a discarding device being arranged on a circumferential surface of the cover designed as a non-magnetic hollow cylinder that conveys incoming carrier particles in an axial direction relative to the cover; and a first spiral according to a type of right-handed thread being arranged on the cover, and a second spiral according to a type of left-handed thread being arranged on the cover, and wherein the discarding device being arranged in an area in which the first spiral and the second spiral meet.

10. A method for lifting magnetizable carrier particles, comprising the steps of:

rotating a cover of a collecting element around a stationary stator, and wherein the stator comprises at least one magnet having a pole arranged approximately radial to the cover and a magnetic field which attracts ferromagnetic carrier particles located on a carrier at a distance of an air gap;

providing a surface of the cover with at least one screw-thread like spiral so that, given rotation of the cover, the carrier particles move in an axial direction relative to the cover; and the cover being arranged opposite an intermediate carrier ribbon as said carrier which carries a mixture made of toner particles and magnetizable carrier particles, said air gap being provided between the cover and the mixture.

* * * * *